United States Patent [19]

Roehrig

[11] Patent Number: 4,507,156

[45] Date of Patent: Mar. 26, 1985

[54] CREEP RESISTANT DISPERSION STRENGTHENED METALS

[75] Inventor: Frederick K. Roehrig, Columbus, Ohio

[73] Assignee: Owens-Corning Fiberglas Corporation, Toledo, Ohio

[21] Appl. No.: 597,585

[22] Filed: Apr. 9, 1984

[51] Int. Cl.[3] ..... B22F 3/24

[52] U.S. Cl. ..... 148/11.5 P

[58] Field of Search ..... 148/11.5 P, 158; 75/252

[56] References Cited

U.S. PATENT DOCUMENTS

| | | | |
|---|---|---|---|
| 3,547,712 | 12/1970 | Bourne et al. | 148/11.5 P |
| 4,274,852 | 6/1981 | McGarry | 148/11.5 P |
| 4,402,746 | 9/1983 | Ramanarayanan et al. | 148/11.5 P |
| 4,402,767 | 9/1983 | Hinze et al. | 148/11.5 P |

*Primary Examiner*—W. Stallard

*Attorney, Agent, or Firm*—Ronald C. Hudgens; Robert F. Rywalski

[57] ABSTRACT

A method of enhancing the creep properties of thermal mechanical processed creep resistant platinum-based alloys by heating the alloy, which is dispersion-strengthened with yttria, to a temperature not less than about 2800° F. for a period of not less than about 6 hours and cooling the alloy in air.

7 Claims, No Drawings

CREEP RESISTANT DISPERSION STRENGTHENED METALS

The present application is a continuation-in-part of U.S. Ser. No. 366,897, filed Apr. 9, 1982, which application is now abandoned.

This invention pertains to dispersion strengthened metals.

In one of its more specific aspects, this invention pertains to heat treatment of dispersion strengthened precious metals for the purpose of enhancing creep resistance.

BACKGROUND OF THE INVENTION

Recent progress in metallurgy has been concerned with the production of wrought composite metal powder, or mechanically alloyed metal powder, wherein a plurality of starting constituents in the form of powders, at least one of which is a compressively deformable metal, are intimately united together to form a mechanical alloy within individual particles without melting any one or more of the constituents. Such materials have been found to possess improved properties of creep resistance.

Such material, having improved properties of creep resistance, is known as "creep resistant platinum". Specifically, creep resistant platinum, as used herein, refers to a material consisting essentially of platinum and yttria (yttrium oxide) in which the amount of yttria is approximately 0.15 weight percent, that is, 0.65 volume percent.

Benjamin in his U.S. Pat. No. 3,591,362, teaches such a composite metal having at least two metal constituents having a high melting point and up to about 25% by volume of a refractory dispersoid, and having a striated internal structure of mechanically alloyed metal fragments.

Another dispersion strengthened consolidated metal product is taught by Benjamin in his U.S. Pat. No. 3,738,817 wherein he disclosed such a product as being produced from mechanically alloyed metal powder selected from the group consisting of nickel, copper, copper alloys, low alloy steels, monaging steels, zinc-base metals; the columbium-base, tantalum-base, molybdenum-base and tungsten-base refractory metals and the platinum metals and gold-base metals, characterized by a uniform dispersion of about 0.05 to 25 volume per cent of a refractory compound dispersoid in both the longitudinal and transverse direction such that the consolidated metal product contains less than 10 volume percent of segregated regions exceeding three microns in minimum dimensions.

Further, Benjamin in his U.S. Pat. No. 3,738,817 teaches dispersion strengthened consolidated metal products produced by mechanically alloying metal powder, including platinum-base metals, with a refractory compound dispersoid in both the longitudinal and transverse direction.

Subsequent developments have related to thermomechanical processing of dispersion-strengthened precious metal alloys in which, by a series of mechanical deformation and annealing cycles, a creep resistant structure is obtained. The mechanical deformation involves rolling the alloy to obtain a reduction in area and then annealing the rolled alloy for a defined period at elevated temperatures. Generally, annealing times of about five minutes at about 1050° C., prior to further repetition of the rolling and annealing process, have been found satisfactory in the thermomechanical processing of creep resistant platinum. However, such materials as creep resistant platinum which has been thermomechanically processed in this manner will show a creep extension of about 0.03 inches after subjection for eighty hours to temperatures of about 2800° F. at 2000 psi. Since bushings employed in the manufacture of glass fibers operate at temperatures of about 2100° F., bushings produced from creep resistant platinum which has been thermomechanically processed, because of creep, even under more moderate conditions, tend to have unsatisfactory operating lives.

STATEMENT OF THE INVENTION

There has now been discovered a method of enhancing the creep properties of thermomechanically processed creep resistant platinum-based alloys which comprises heating the alloy to a temperature not less than about 2800° F. for a period of not less than about 4 hours and cooling the alloy in air to room temperature.

BRIEF DESCRIPTION OF THE INVENTION

The heat treatment is characterized by a large, elongated grain structure effect by a secondary recrystallization in the platinum-based alloy.

In the preferred method of practicing the invention, the alloy is held at about 2800° F. for about 6 to about 90 hours, preferably about 80 hours. This method is particularly suitable for creep resistant platinum formed from dispersion-strengthened platinum.

EXAMPLE I

The creep resistant platinum employed in this example was yttrium oxide dispersion-strengthened platinum. It had been thermomechanically processed by alternating thickness reduction achieved by cold rolling followed by annealing. The cold rolling consisted of nominally 10% reduction in area. These cycles of rolling/annealing were done to convert the powder metallurgical compact into sheet stock useful for bushing tip plate construction, the bushing being employable for the production of glass fibers. This thermomechanical processing, imparts a creep-resistant microstructure to the final sheet material.

A creep resistant platinum, thermomechanically processed was subjected to heat treatment at 2800° F. for 79 hours. The creep of this material (I) compared to the creep of creep resistant platinum, thermomechanically processed but not subject to the heat treatment (II) when subjected to 2800° F. and 2000 psi for 79 hours was as follows:

| | Creep Extension, In. | |
|---|---|---|
| Time, Hours | I | II |
| 10 | .002 | .032 |
| 20 | .005 | .034 |
| 30 | .0070 | .035 |
| 40 | .0080 | .035 |
| 50 | .0090 | .035 |
| 60 | .0095 | .036 |
| 70 | .010 | .036 |
| 79 | .010 | .037 |

These data demonstrate the improvement which the method of this invention imparts to thermomechanically processed creep resistant platinum.

It will be evident from the foregoing that various modifications can be made to the method of this invention. Such, however, are considered within the scope of the invention.

I claim:

1. A method of improving the creep resistance of a thermo-mechanical processed creep resistant platinum-based alloy which comprises heating the alloy to a temperature not less than about 2800° F. for a period not less than about 6 hours.

2. The method of claim 1 in which said alloy is cooled in air to room temperature.

3. The method of claim 1 in which said alloy is held at said temperature for a period of from about 6 to about 90 hours.

4. The method of claim 1 in which said alloy is held at said temperature for a period of about 80 hours.

5. The method of claim 1 in which the grain structure of the alloy is converted to a large elongated grain structure affected by a secondary recrystallization in the alloy.

6. The method of claim 1 in which the platinum based alloy has a creep of 0.010 inch at 2800° F. and 2000 psi after 79 hours.

7. An article of manufacture fabricated from the composition of matter produced by the method of claim 1.

* * * * *